US005286593A

United States Patent [19]

Landa et al.

[11] Patent Number: 5,286,593

[45] Date of Patent: Feb. 15, 1994

[54] LIQUID DEVELOPER CONTAINING STABILIZED CHARGE DIRECTOR COMPOSITION

[75] Inventors: Benzion Landa, Edmonton, Canada; Yaacov Almog, Rehovat, Israel

[73] Assignee: Spectrum Sciences B.V., Wassenaar, Netherlands

[21] Appl. No.: 833,232

[22] Filed: Feb. 10, 1992

Related U.S. Application Data

[60] Division of Ser. No. 630,339, Dec. 17, 1990, Pat. No. 5,264,313, which is a continuation of Ser. No. 306,155, Feb. 6, 1989, abandoned, which is a continuation-in-part of Ser. No. 45,168, Apr. 24, 1987, Pat. No. 4,842,974.

[51] Int. Cl.[5] ..... G03G 9/135

[52] U.S. Cl. ..... 430/115

[58] Field of Search ..... 430/114, 115, 126

[56] References Cited

U.S. PATENT DOCUMENTS

| | | | |
|---|---|---|---|
| 4,886,729 | 12/1989 | Grushkin et al. | 430/115 |
| 4,925,766 | 5/1990 | Elmasry et al. | 430/115 |
| 4,937,158 | 6/1990 | Larson | 430/115 |

*Primary Examiner*—John Goodrow
*Attorney, Agent, or Firm*—Kenyon & Kenyon

[57] ABSTRACT

A method for stabilizing a charge director solution, and a charge director composition made by this method, whereby a charge director is mixed with a solvent and a polar monomer species and a polymerization reaction is initiated and allowed to progress to completion.

7 Claims, 5 Drawing Sheets

CHARACTERISTIC CURVES OF CURRENT IN LECITHIN SOLUTIONS.
1-4 ARE THE NUMBERS OF SUCCESSIVE PULSES RESPECTIVELY.

LIQUID DEVELOPER CONTAINING STABILIZED CHARGE DIRECTOR COMPOSITION

This is a division of application Ser. No. 07/630,339 filed on Dec. 17, 1990, now U.S. Pat. No. 5,264,313, which is a continuation of Ser. No. 07/306,155 filed on Feb. 6, 1989, now abandoned, which is a continuation-in-part of Ser. No. 07/045,168 filed Apr. 24, 1987 now issued as U.S. Pat. No. 4,842,974.

BACKGROUND OF THE INVENTION

The present invention relates to liquid developer electrostatic photocopying and more particularly to a method of stabilizing charge director solutions and a new stabilized charge director composition.

Processes for forming electrostatic images, existing as electrostatic charge patterns upon a substrate, are well known. In electrostatic printing or copying, a photoconductive imaging surface is first provided with a uniform electrostatic charge, typically by moving the imaging surface past a charge corona at a uniform velocity. The imaging surface is then exposed to an optical image of an original to be copied. This optical image selectively discharges the imaging surface in a pattern to form a latent electrostatic image. In the case of an original bearing dark print on a light background, this latent image consists of substantially undischarged "print" portions corresponding to the graphic matter on the original, amidst a "background" portion that has been substantially discharged by exposure to light. The latent image is developed by exposure to oppositely charged, pigmented, toner particles, which deposit on the print portions of the latent image in a pattern corresponding to that of the original.

In liquid developer photocopiers, these charged toner particles are suspended in a liquid developer comprising a carrier liquid, toner particles and charge directors. The entire latent electrostatic image is covered with a thin film of liquid developer from a liquid developer reservoir. The charged toner particles in the liquid developer migrate to the oppositely charged "print" portions of the latent image to form a pattern on the photoconductive surface. This pattern, and the corresponding toner particles, are then transferred to a sheet to produce a visible image. Any liquid developer remaining on the photoconductive surface after this process is recycled back into the liquid developer reservoir.

Charge director plays an important role in the developing process described above. The charge director is a chemical species, either molecular or ionic, which acts to control the polarity and charge on the toner particles. The charge director creates charged species causing charging of the imaging material to ensure that the toner particles will be deposited and migrate in such a way as to form the desired image, on the imaging surface. Counter ions are also created to keep the liquid developer substantially electrically neutral overall. The present invention may be practiced with any number of charger directors, of which lecithin and barium petronate are examples.

One of the major problems concerning the material used as charge directors is the degradation of the charge carrying species under the application of the electric field created during the electrophoretic development process. Degradation of the charge carrying species also occurs during replenishment of developer with carrier liquid due to dilution of the charge director.

Degradation of the charge carrying species destabilizes the liquid developer electrically. Since stable electrical characteristics of the liquid developer are important to achieve a high quality image, particularly when a large number of impressions are to be produced without changing the liquid developer dispersion, degradation of the charge carrying species results in poor copy quality.

It is believed that in many liquid developers the charge director molecules form inverse micelles. An example of these micelles is shown in FIG. 1. The micelles are formed by aggregation such that the polar portions of the charge director molecules point inside, and the nonpolar portions point outside to decrease the overall surface energy of the system. These micelles may solubilize ions generated by the dissociation of the charge director molecules. It is believed that the solubilization of ions by the charge director micelles is due to the formation within and around the micelles, of a microenvironment having a higher dielectric constant. The solubilization of ions by the charge director micelles results in micelles containing a charged species in their center. Some of the micelles have a positive species in the center and others have a negative species in the center. We believe that during the electrophoretic developing process these micelles rupture under the influence of the electric field created by the charged; photoconductive surface. The exact mechanism of the rupturing is not known. The rupture of the micelles changes the electrical properties of the liquid developer solution by freeing the charged species in the center of the micelles which, due to their relatively strong positive and negative charges and the low dielectric constant of the carrier liquid, tend to reassociate with each other to form electrically neutral compounds. The formation of these electrically neutral compounds changes the overall electrical properties of the liquid developer. The change in electrical properties of the liquid developer changes the toner particle dispersion in the liquid developer and the number of the charge-carrying species resulting in a degradation in copy quality.

We also believe that the micelles rupture when the liquid developer dispersion in a photocopier is replenished by the addition of new carrier liquid. Again, the exact mechanism is not known. The effect of this rupturing is manifested in an instability of the charge-carrying species in the system. Again, the overall result is a degradation in copy quality.

Accordingly, one object of the present invention is a charge director composition which will resist degradation under the influence of an electric field.

Another object of the present invention is a charge director composition which will resist degradation during the replenishment of carrier liquid in a liquid developer dispersion.

A further object of the present invention is a charge director solution which will resist destabilization.

SUMMARY OF THE INVENTION

Figure 1:
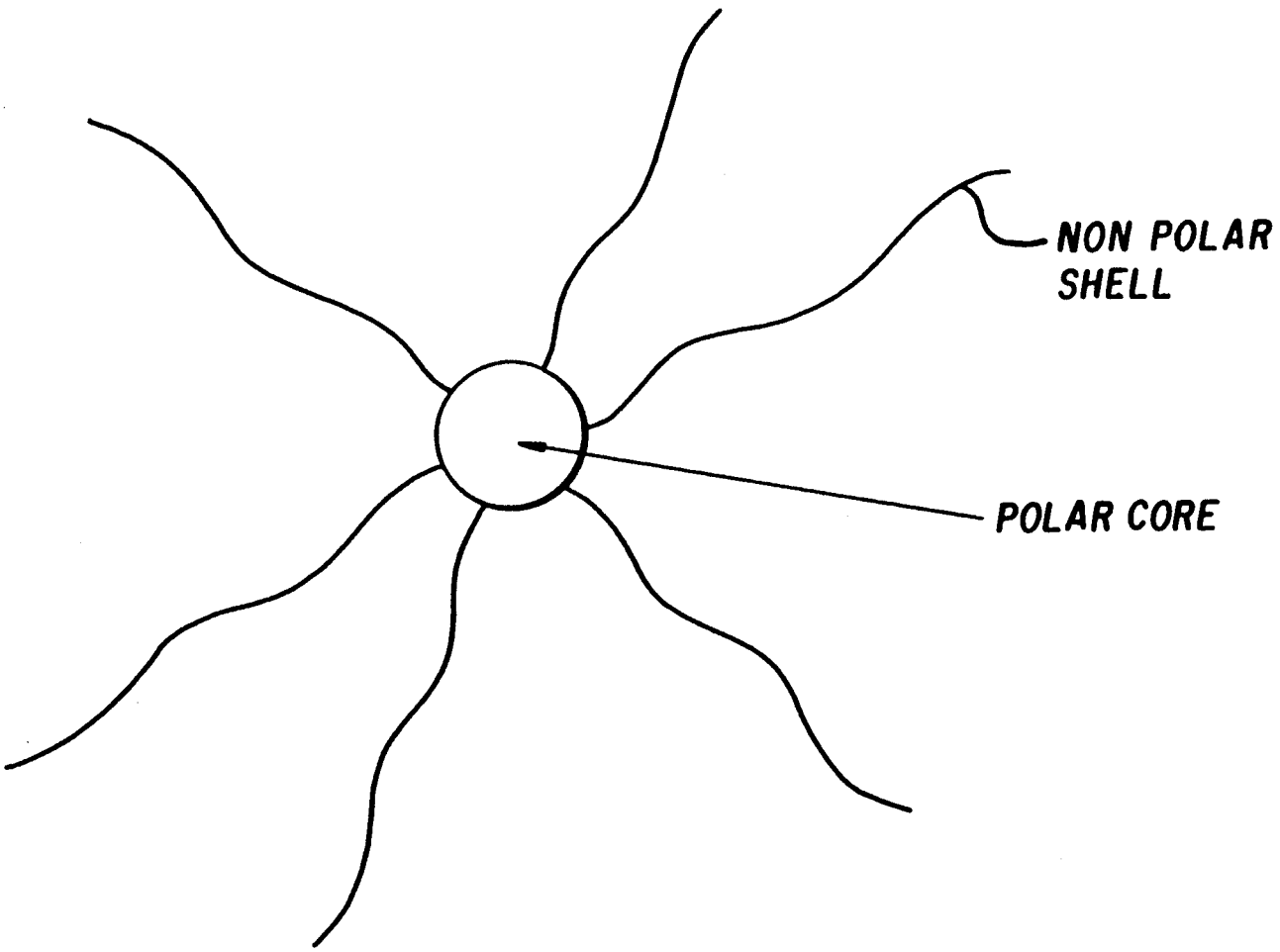
FIG. 1 is an idealized depiction of charge director micelles.

The present invention is directed to a method of stabilizing a charge director solution wherein a charge director, a solvent, and a polar monomer species are mixed, and subsequently the monomer molecules are polymerized. An initiator species is used to begin the polymerization and the reaction is allowed to proceed to substantial completion. We believe that the result is a chemical incorporation of a polar polymer species into the core of the charge director micelles. The polar species stabilizes the core of the micelles and reduces the possibility of the micelle rupturing.

In accordance with the present invention, charge director micelles are associated with insoluble polymer molecules so that the charged species are more stable and less susceptible to degradation. It will be appreciated that by reducing the degradation of the charged species of the liquid developer composition the images formed by the developer will be denser over a longer period of usage, since the presence of the charged species is essential to the electrophoretic imaging process.

DETAILED DESCRIPTION

In our invention, a charge director, a solvent, and a polar monomer species are mixed, and subsequently the monomer molecules are polymerized. An initiator species is used to begin the polymerization and the reaction is allowed to proceed to substantial completion. While the polymer species which are formed are not soluble, the monomeric species of the present invention are soluble in the solvent containing the charge director. The charge director, which is at least partially present as micelles, acts as a surfactant for the polymerization of the monomer species. It is believed the monomer species clings to the micelle and polymerizes in the core of the micelle.

The selected solvent may be any suitable solvent in which the necessary polymerization may occur. Many nonpolar solvents will work well in the present invention, including: Isopar (a trademarked product of the Exxon Corporation) which is a high-purity isoparrafinic material, Isoparafine, hexane, cyclohexane, t-butylbenzene, 2,2,4-trimethylpentane, and normal paraffins. The monomer species chosen may be any unsaturated monomer that is soluble in the selected solvent and polymerizes in the solvent in the presence of an appropriate initiator. It is believed a large number of unsaturated molecules will work well in the present invention as; a monomer, but certain species should work especially well, including 1-vinyl-2-pyrrolidone, 2-vinyl pyridine, vinylfuran, and methyl methacrylate.

It is believed that the initiator may be any one of a large number of species which will initiate a polymerization reaction, including azobisbutyronitrile, benzoyl peroxide, triphenylazobenzene, cumene hydroperoxide, and t-butyl peracetate.

In one preferred embodiment of the present invention, Isopar is heated to approximately 50 degrees C. in a reaction vessel fitted with a reflux condensor. The reaction is run under a nitrogen atmosphere. Lecithin is slowly mixed into the Isopar. The solution is heated to about 80 degrees–90 degrees C. and 1-vinyl-2-pyrrolidone is added, followed by a polymerization initiator, e.g., azobisbutyronitrile. The temperature is kept constant, and the reaction is allowed to proceed for about 24 hours. The charge director composition formed by this process will be less subject to degradation of the charge-carrying species than a composition lacking the stabilizing polymer molecules. This superior resistance to degradation will be exhibited both when an electric current is applied to the composition, and when the composition is diluted with solvent (Isopar).

It is preferred to use a non-polar solvent in which the-1-vinyl-2-pyrrolidone monomer is soluble, but the polymer is insoluble. The solvent should boil at a significantly higher temperature than 90° C., so that it will remain liquid under the reaction conditions. It is believed that, as the polymerization reaction progresses, the polymer molecules will reach a critical length above which they are insoluble in the solvent; a very fine dispersion of these polymer molecules in the solvent results, and the charge director micelles form around the polymer molecules. The micelles in turn are rigidized and stabilized by the polymer molecules. The critical percent of vinyl pyrrolidone polymer needed to obtain a large stabilization effect is between about 5–9% on a weight-to-weight basis with respect to the charge director solids. With a polymer concentration of 9% or more, very little degradation of the charged species occurs upon dilution with solvent or the imposition of an electric field. Below a 5% polymer concentration, however, a significant amount of degradation will occur. The present invention is further illustrated by, but not limited to, the following examples.

EXAMPLE I

Under a nitrogen atmosphere, 1400 grams of Isopar-H was heated to 50 deg. C. in a 4-necked, 2 liter, mechanically stirred glass reactor fitted with a reflux condensor. 600 grams of lecithin was dissolved in the Isopar-H by slow addition and stirring. The Isopar-H/Lecithin solution was then heated to 80° C. and then 102 grams of 1-vinyl-2-pyrrolidone was added to the solution. Three grams of azobisbutyronitrile suspended in 10–20 ml. of Isopar-H was then added, and the reaction allowed to proceed for 24 hours to completion.

EXAMPLE II 500 grams Isopar-H, 10 grams of lecithin, and 1.7 grams 1-vinyl-2-pyrrolidone were mixed at 90 deg. C. in a 4-necked glass roundbottom flask under an $N_2$ atmosphere. 0.5 grams azobisbutyronitrile was dispersed in 20 grams of Isopar and added. The reaction was allowed to proceed for 17½ hours. The resulting solution was clear, and somewhat darker than a solution of lecithin in Isopar.

The advantages of the present invention are illustrated by the following experimental results.

Figure 2:
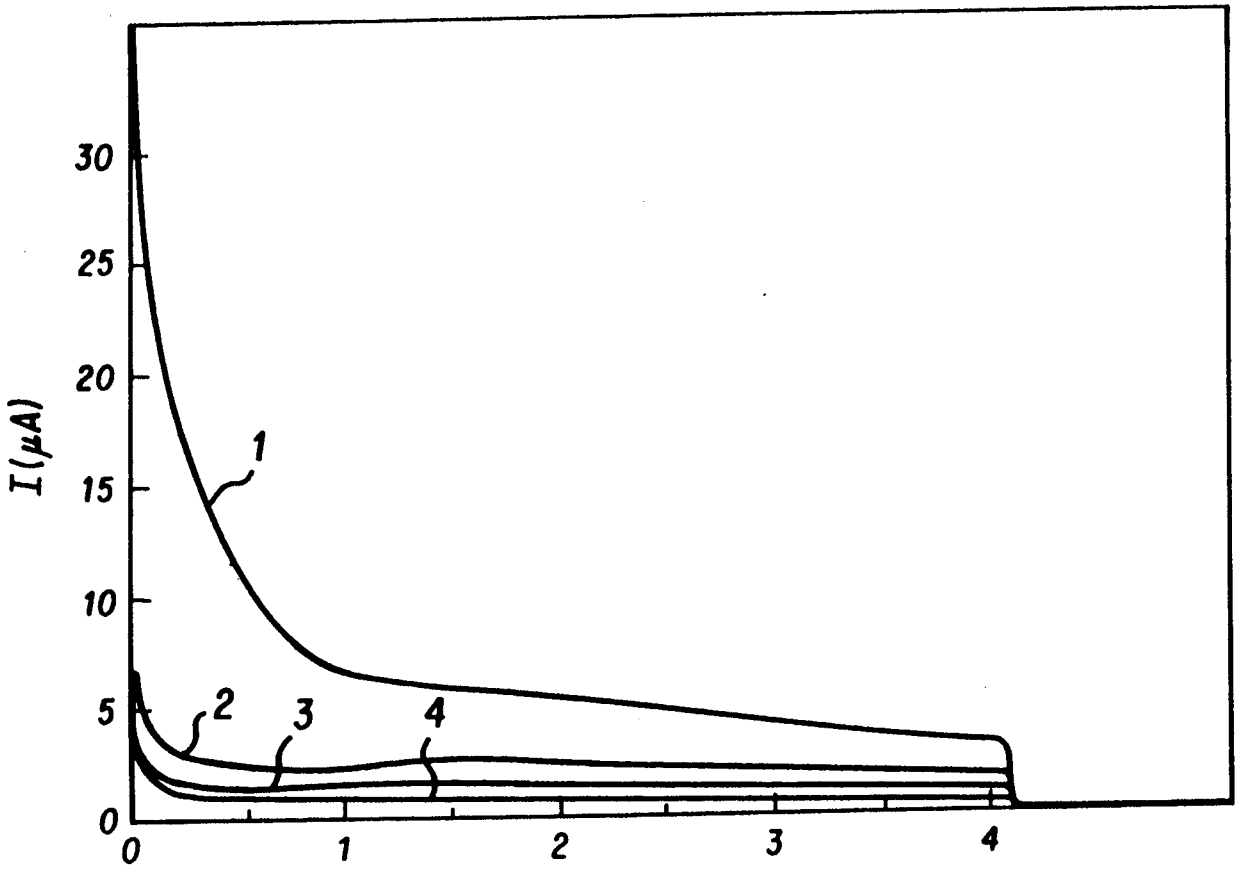
FIG. 2 is a graphic representation of the current in a lecithin solution for 4 successive electric pulses.

Table 1 and FIG. 2 show the results of our experiment on the effect of an applied electric field to a common unstabilized charge director, lecithin, solution. In the experiment 800 V. DC pulses were sequentially applied to a cell containing a lecithin solution for 4 seconds and the charge transport of the lecithin solution for each pulse was measured. Table 1 shows the charge transport in the solution for each pulse. FIG. 2 is a graphic representation of the current the lecithin solution during the time period of the pulse. (Table 1) As shown in Table 1 and FIG. 2 the application of an electric pulse to a charge director solution changes the electrical properities of the solution. The applied electric pulse of the experiment is similar to the electric field created during the copying process. Thus the effect of the electric pulse on the lecithin solution resembles the effect of the electric field created during the copying process on the liquid developer solution.

Figure 3:
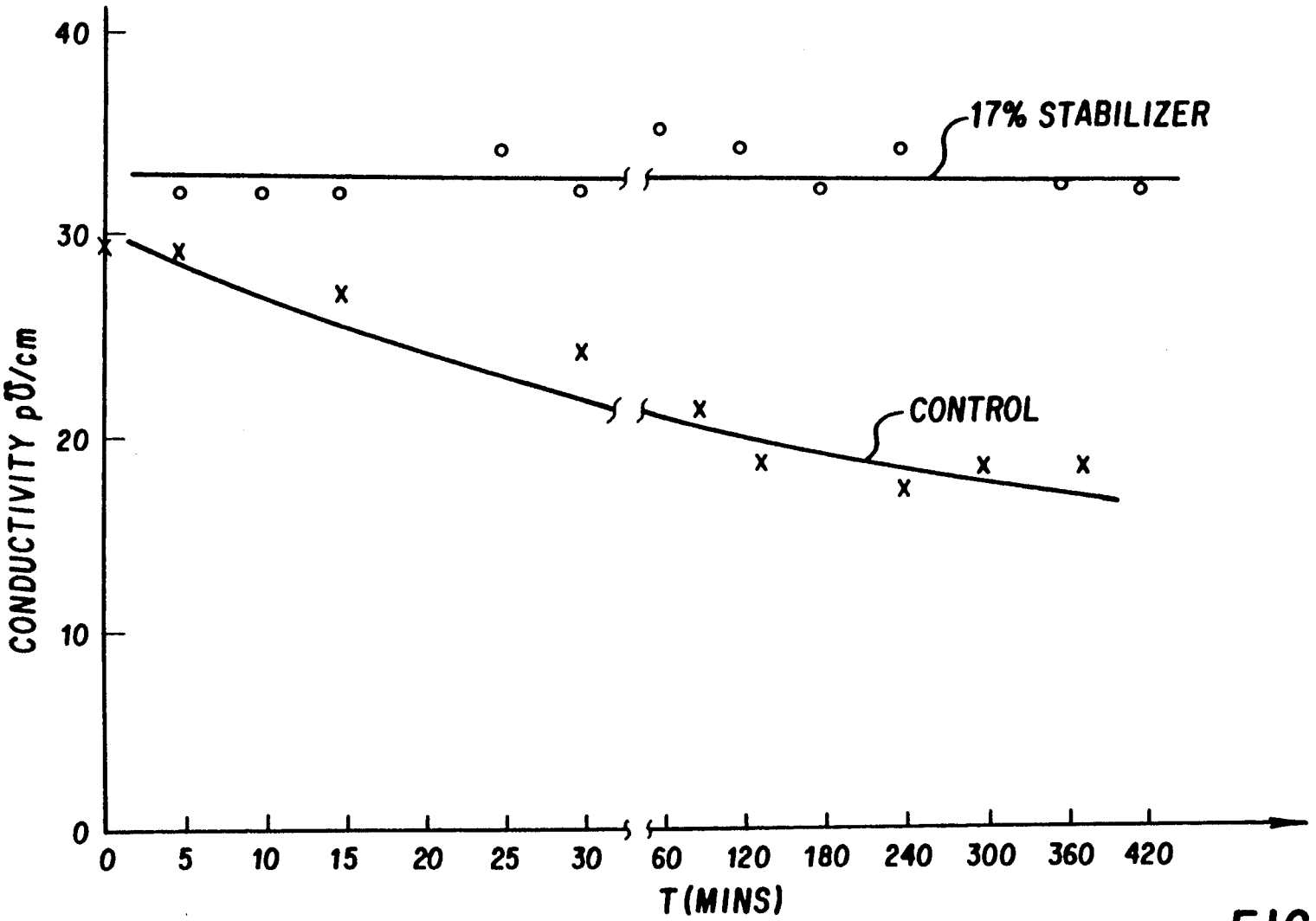
FIG. 3 is a graphic representation of the conductivity kinetics under dilution of lecithin and the material of the present invention.

FIG. 3 shows the conductivity of a composition comprising 17% monomer stabilized species by weight with respect to charge director solids, according to the present invention as compared to a lecithin control, in both cases after addition of a carrier liquid such as Isopar H. As shown in FIG. 3, the conductivity of the stabilized composition in Isopar remains relatively constant with time, while that of the control decreases with time. Thus, the stabilized composition of the present invention is advantageous for use in a photocopier since the conductivity will not change appreciably with time.

Figure 4:
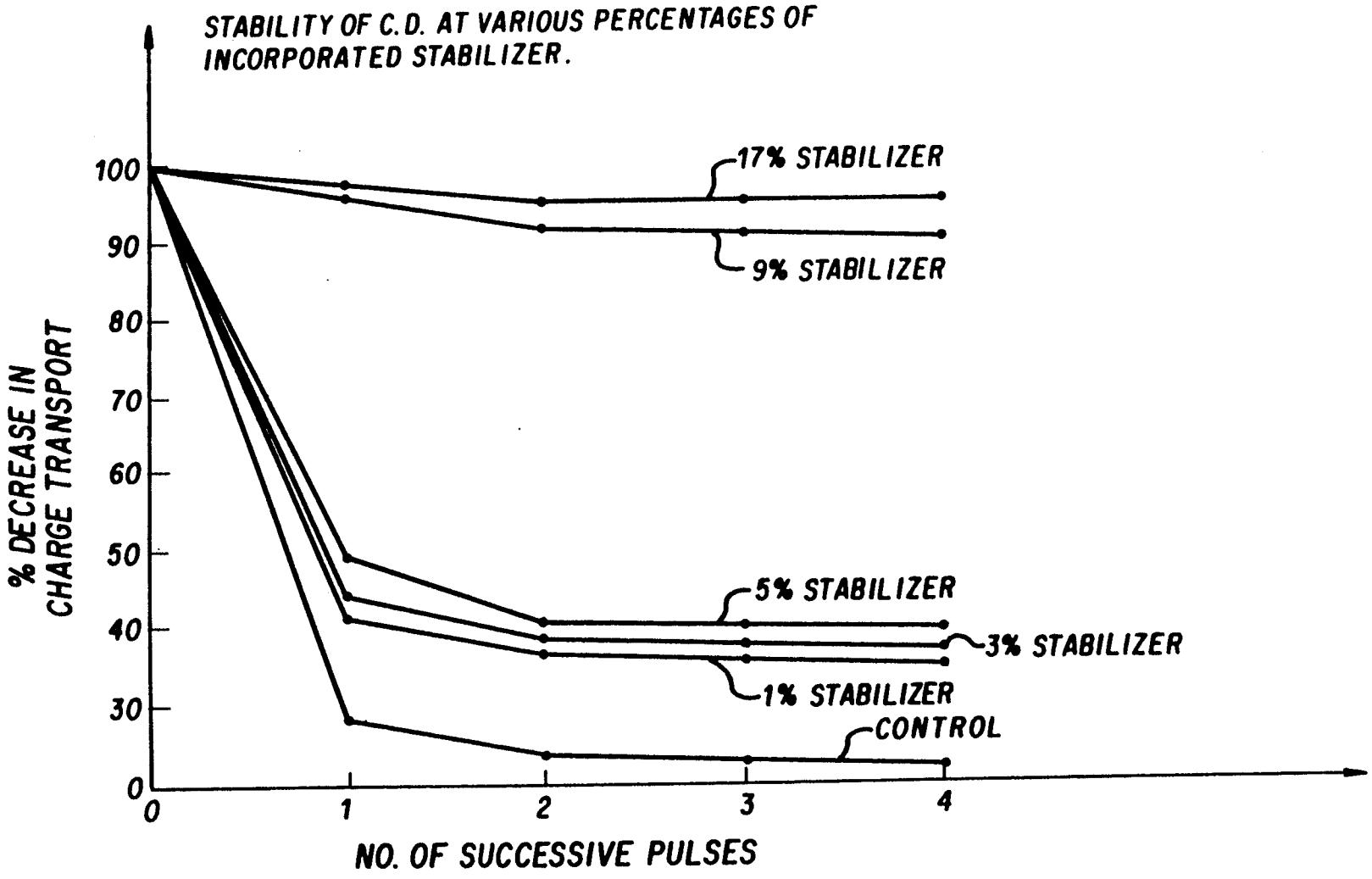
FIG. 4 is a graphic representation of the stability of various charge director compositions of the present invention.

FIG. 4 shows the results of a similar experiment on various stabilized charge director compositions according to the present invention. In this experiment 4, 800 V. DC pulses were sequentially applied to a cell containing a charge director solution and the total charge transport in the cell was measured for each pulse. The control charge director solution was an unstabilized lecithin solution as used in the above-mentioned experiment. Five stabilized charge director solutions made according to the present invention were also tested. Each charge director solution was made with a different percentage of the monomer stabilizing species. As shown in FIG. 4, the charge director should comprise between 5% and 9% by weight with respect to charge director solids or more of the monomer stabilizing species to achieve a high degree of charge transport constancy. As also shown in FIG. 4, little degradation in charge transport is maintained by a charge director composition comprising 17% monomer stabilizing species by weight with respect to charge director solids.

Figure 5:
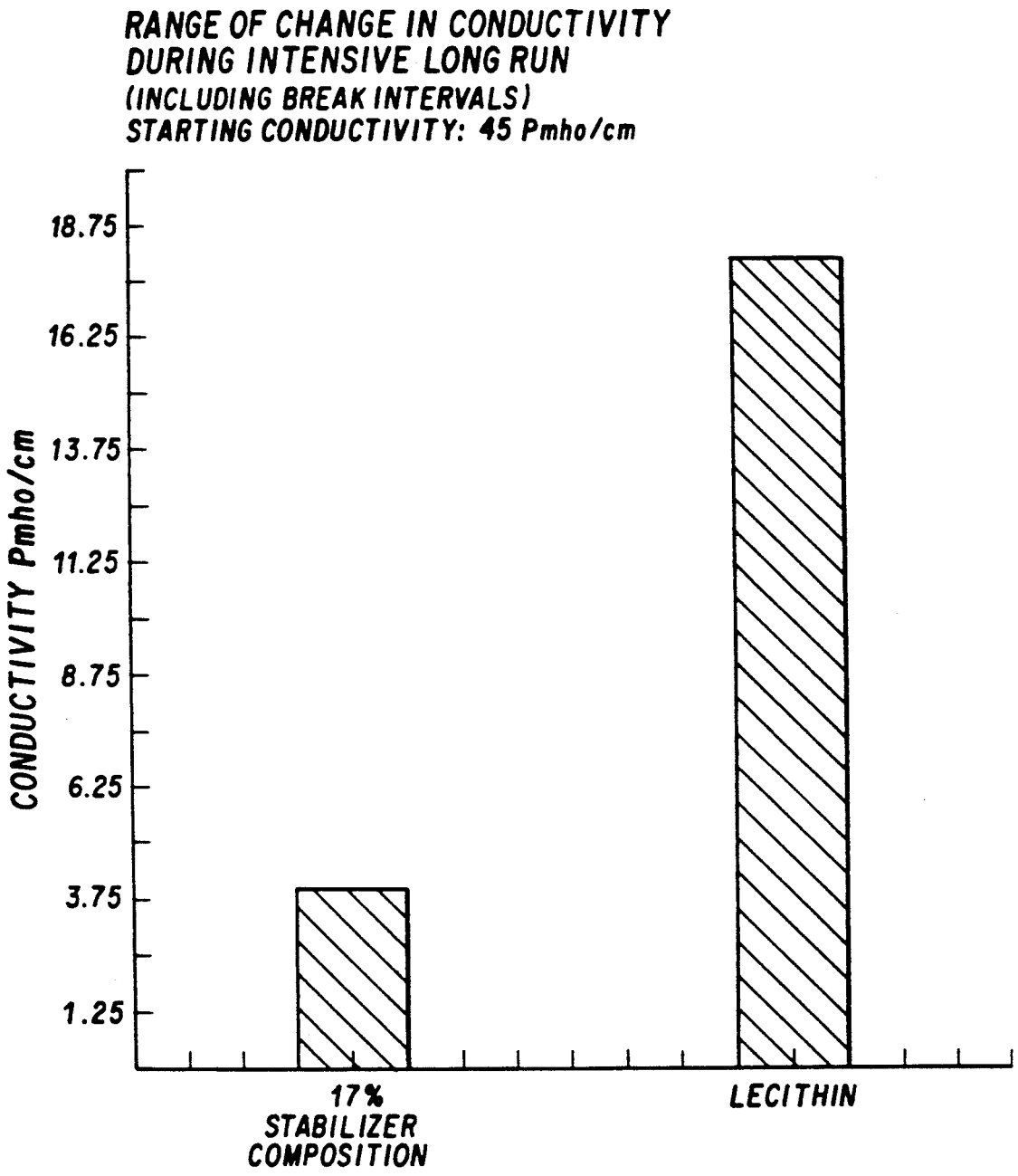
FIG. 5 shows the absolute change in conductivity during a long developing run for a 21% coverage target for lecithin and a charge director of the present invention.

FIG. 5 shows the results of an experiment on the decrease in conductivity of a charge director solution during continuous electrophotocopier operation with no paper feed. The lecthin charge director solution shown on the chart is an unstabilized ordinary charge director solution. The other charge director is made according to example 1 of the present invention comprising 17% monomer stabilizing species by weight with respect to charge director solids. As discussed in a proceeding section, we believe that during the electrophotographic process unstabilized charge director micelles rupture, causing the decrease in the number of charge species, and thus a decrease in bulk conductivity of the liquid developer and a degradation in copy quality. As shown in FIG. 5, the unstabilized lecithin solution had a decrease of an 18 picomho/cm in conductivity during the electrophotocopier operation. The solution comprising 17% monomer stabilizing species by weight with respect to charge director solids made according to example 1 of the present invention, however, showed only a 4 picomho/cm decrease in conductivity during continuous electrophotocopier operation.

It should be understood that the foregoing descriptions are for the purpose of illustration only and that the invention includes all modifications falling within the scope of the following claims.

We claim:

1. A liquid developer comprising:
a carrier liquid,
toner particles, and
a stabilized charge director including:
a polymer insoluble in said carrier liquid and a charge director, soluble in said carrier liquid and at least partially present in the form of micelles, wherein said polymer is chemically incorporated into said micelles.

2. The liquid developer of claim 1, wherein the charge director is lecithin.

3. The liquid developer of claim 1, wherein the polymer is polyvinylpyrrolidone.

4. A liquid developer comprising:
a carrier liquid,
toner particles, and
a stabilized charge director composition formed by mixing a charge director, at least partially present in the form of micelles, with a solvent and a monomer species and then initiating a polymerization reaction among molecules of said monomer species and allowing said polymerization reaction to progress to completion, to produce a polymer which is chemically incorporated into said micelles.

5. The liquid developer of claim 4 wherein the stabilized charge director is at least partially present in the form of micelles and said charge director acts as a surfactant for the polymerization of the monomer species.

6. The liquid developer of claim 4, wherein the solvent is the carrier liquid.

7. The liquid developer of claim 4, wherein the charge director is lecithin.

* * * * *